US010723428B1

(12) United States Patent
Vicari et al.

(10) Patent No.: US 10,723,428 B1
(45) Date of Patent: Jul. 28, 2020

(54) TROLLING MOTOR MOUNTING SYSTEM

(71) Applicants: Nicholas Alexander Vicari, Tampa, FL (US); John David Oliverio, Brandon, FL (US)

(72) Inventors: Nicholas Alexander Vicari, Tampa, FL (US); John David Oliverio, Brandon, FL (US)

(73) Assignee: JL MARINE SYSTEMS, INC., Tampa, FL (US)

( * ) Notice: Subject to any disclaimer, the term of this patent is extended or adjusted under 35 U.S.C. 154(b) by 0 days.

(21) Appl. No.: 16/602,211

(22) Filed: Aug. 28, 2019

(51) Int. Cl.
*B63H 20/02* (2006.01)
*B63H 20/00* (2006.01)

(52) U.S. Cl.
CPC ..... *B63H 20/02* (2013.01); *B63H 20/007* (2013.01)

(58) Field of Classification Search
CPC ..... B63H 20/02; B63H 20/007
See application file for complete search history.

(56) References Cited

U.S. PATENT DOCUMENTS 3,593,050 A * 7/1971 Ware ..... H02K 5/132 310/87
6,160,764 A * 12/2000 Powell ..... B63B 49/00 367/173
7,306,496 B1 * 12/2007 Carmen ..... B63H 20/007 440/1

* cited by examiner

*Primary Examiner* — Stephen P Avila
(74) *Attorney, Agent, or Firm* — Arthur W. Fisher III, P.A.

(57) ABSTRACT

A trolling motor mounting system comprising a housing to at least partially enclose a drive unit of a trolling motor, and a shaft to couple the trolling motor to a boat wherein the shaft includes a first passage or channel extending at least a major portion thereof and the housing includes a second passage or channel extending from the first passage or channel to the drive unit to cooperatively form a passageway to receive a conductor therethrough to supply power and data from the boat to the drive unit to seal and isolate the conductor from the surrounding environment.

16 Claims, 6 Drawing Sheets

TROLLING MOTOR MOUNTING SYSTEM

BACKGROUND OF THE INVENTION

Field of the Invention

A trolling motor mounting system to mount a trolling motor to a boat including a passageway extending from a power source on the boat to the trolling motor to isolate and protect a conductor supplying power to the trolling motor from the surrounding environment.

Description of the Prior Art

Trolling motors are used to provide limited thrust to quietly propel a boat while fishing. Generally, these trolling motors include an elongated tube to couple a lower propulsion unit to an upper trolling motor head unit or junction box.

In addition, sonar systems or depth finders are frequently used to indicate the depth of the water below the lower propulsion unit and to locate fish. Such underwater sonar systems or depth finders include a transducer mounted to the lower propulsion unit. The transducer is connected to a control and display unit on the boat by a conductor extending from the transducer to the control unit.

U.S. Pat. No. 6,325,685 shows a trolling motor system comprising a chassis coupled to a boat, a housing pivotally coupled to the chassis, a lower propulsion unit and a hollow shaft having a cable extending therethrough supported by the housing and coupled to the lower propulsion unit and a drive system.

U.S. Pat. No. 6,661,742 discloses a trolling motor system comprising a propulsion unit and transducer assembly. The propulsion unit has an external cavity extending into the lower propulsion unit; while, the transducer assembly includes a sonar transducer and a mount coupled to the sonar transducer.

U.S. Pat. No. 9,296,455 describes a trolling motor comprising a base assembly with a steering module mounted to the base assembly. A motor shaft assembly including a motor shaft, a head unit attached to an upper end of the motor shaft and a motor power unit attached to a lower end of the motor shaft.

While some of the prior art may contain some similarities relating to the present invention, none of them teach, suggested or include all of the advantages and unique features of the invention disclosed hereafter.

SUMMARY OF THE INVENTION

The present invention relates to a trolling motor mounting system configured to supply power and data from a boat to the trolling motor.

The trolling motor comprises an electric propulsion unit coupled to a propeller or thruster. The electric propulsion unit is electrically connected to an electric power source on the boat by a conductor or cable.

The trolling motor mounting system comprises a system housing including a propulsion unit housing to at least partially enclose the electric propulsion unit coupled to the boat by a rotatable shaft including a first passage or channel.

The propulsion unit housing comprises an upper housing member including a second passage comprising an upper housing passage or channel terminating in an upper port and a lower housing member including a lower housing passage or channel terminating in a lower port coupled together by a tongue and groove arrangement extending longitudinally along opposite sides of the propulsion unit housing.

The system housing further comprises a forward housing forming a forward housing passage or channel having an upper member or projection including an upper forward passage or channel and a lower member or projection including a lower forward passage or channel projecting inwardly from the forward housing. The upper member or projection and the lower member or projection are each configured to support a seal to be press-fit into the upper port and lower port respectively to seal the front portion of the propulsion unit housing and the rear portion of the forward housing together.

When operatively assembled, the first passage or channel and the second passage cooperatively form a passageway from the boat to the electric propulsion unit to receive the conductor or cable that electrically connects or couples the electric propulsion unit to the electric power source in or on the boat. So configured and assembled, the conductor or cable is isolated from the surrounding water.

This summary is not intended to describe essential features of the claimed subject matter nor is it intended to limit the scope of the claimed subject matter. To the contrary, this Summary merely outlines various concepts and features that are developed in the Detailed Description.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
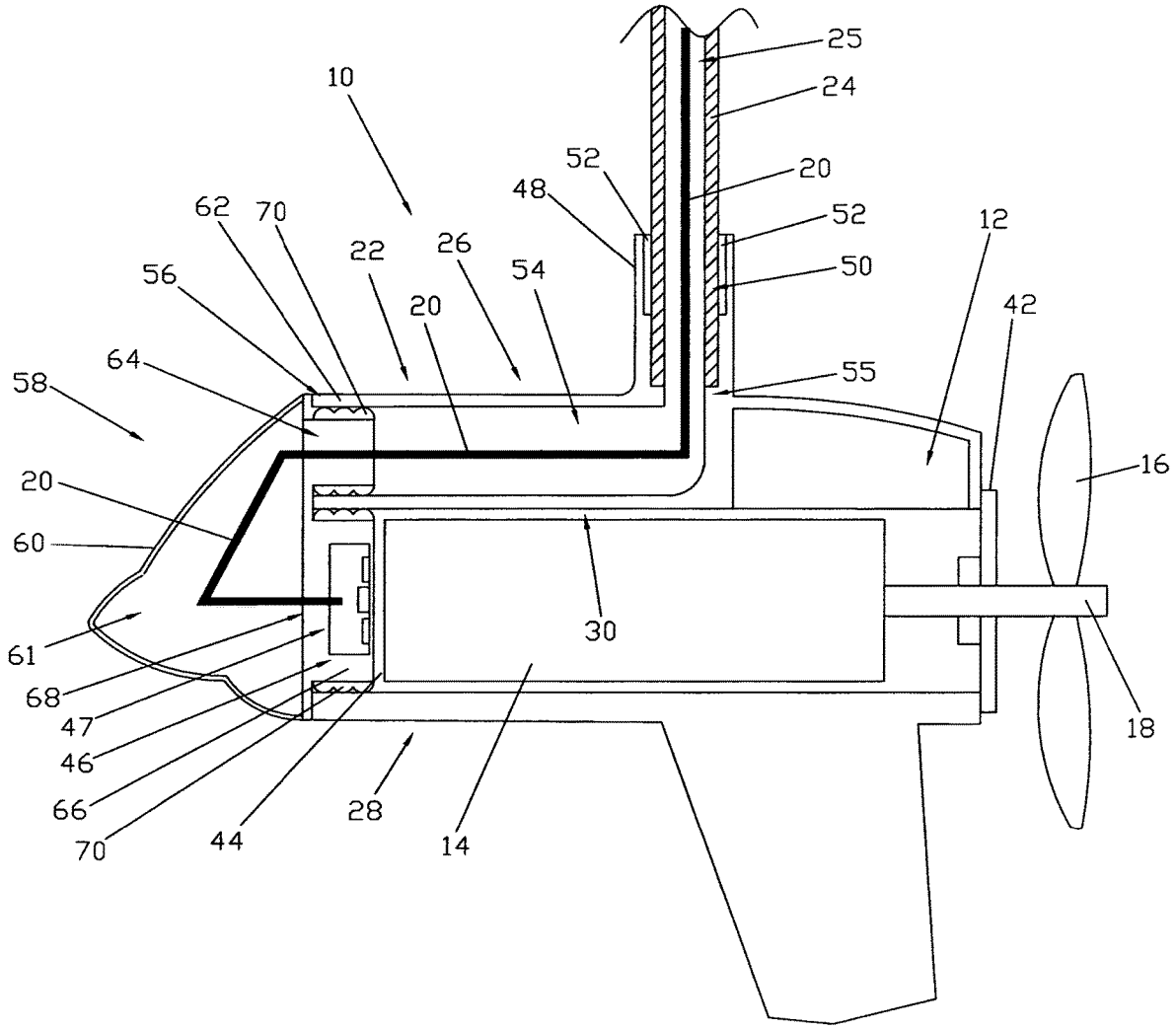
FIG. 1 is a partial cross-sectional side view of the trolling motor mounting system of the present invention.
Figure 2:
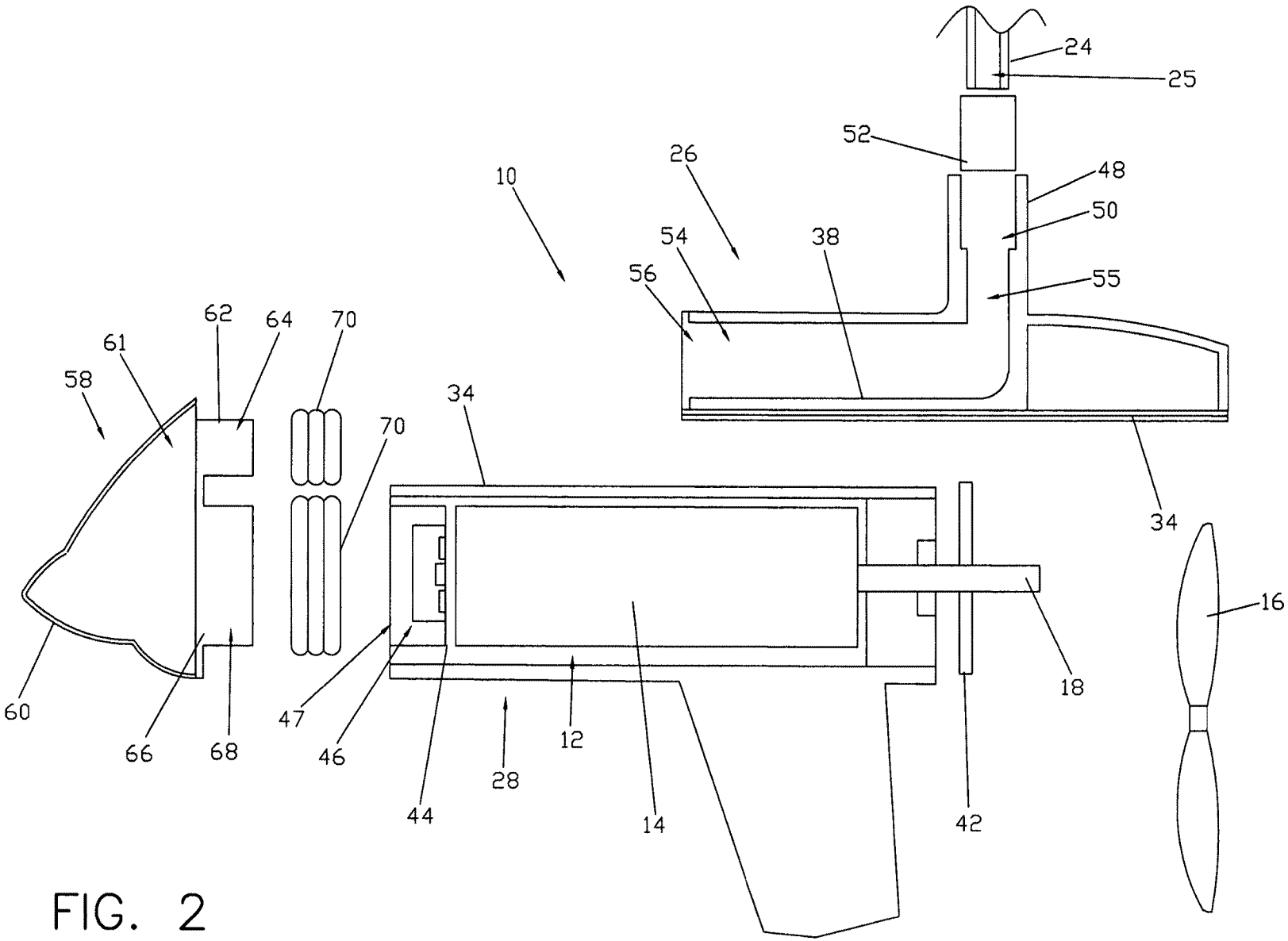
FIG. 2 is an exploded partial cross-sectional side view of the trolling motor mounting system of the present invention.
Figure 3:
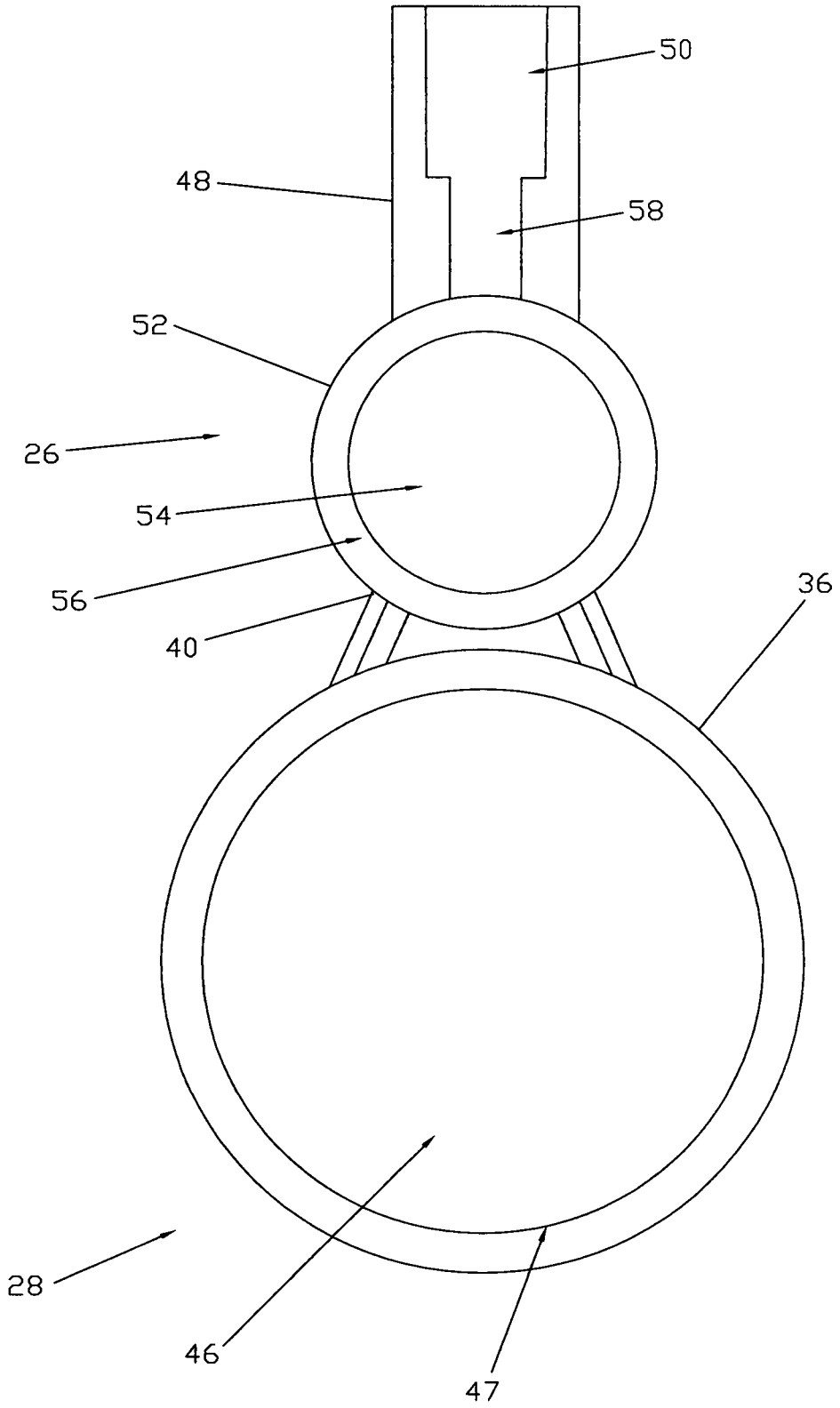
FIG. 3 is a partial end view of the trolling motor mounting system of the present invention.

As shown in FIGS. 1 through 3, the present invention relates to a trolling motor mounting system generally indicated as 10 to mount a trolling motor generally indicated as 12 to a boat (not shown).

The trolling motor 12 comprises an electric drive or propulsion unit 14 coupled to a propeller or thruster 16 by a drive shaft 18. The electric drive or propulsion unit 14 is electrically connected to an electric power source (not shown) on the boat by a conductor or cable 20.

The trolling motor mounting system 10 comprises a system housing including a propulsion unit housing generally indicated as 22 to at least partially enclose the electric drive or propulsion unit 14 coupled to the boat (not shown)

by a rotatable hollow elongated member or shaft 24 including a first or shaft passage or channel 25.

Figure 5:
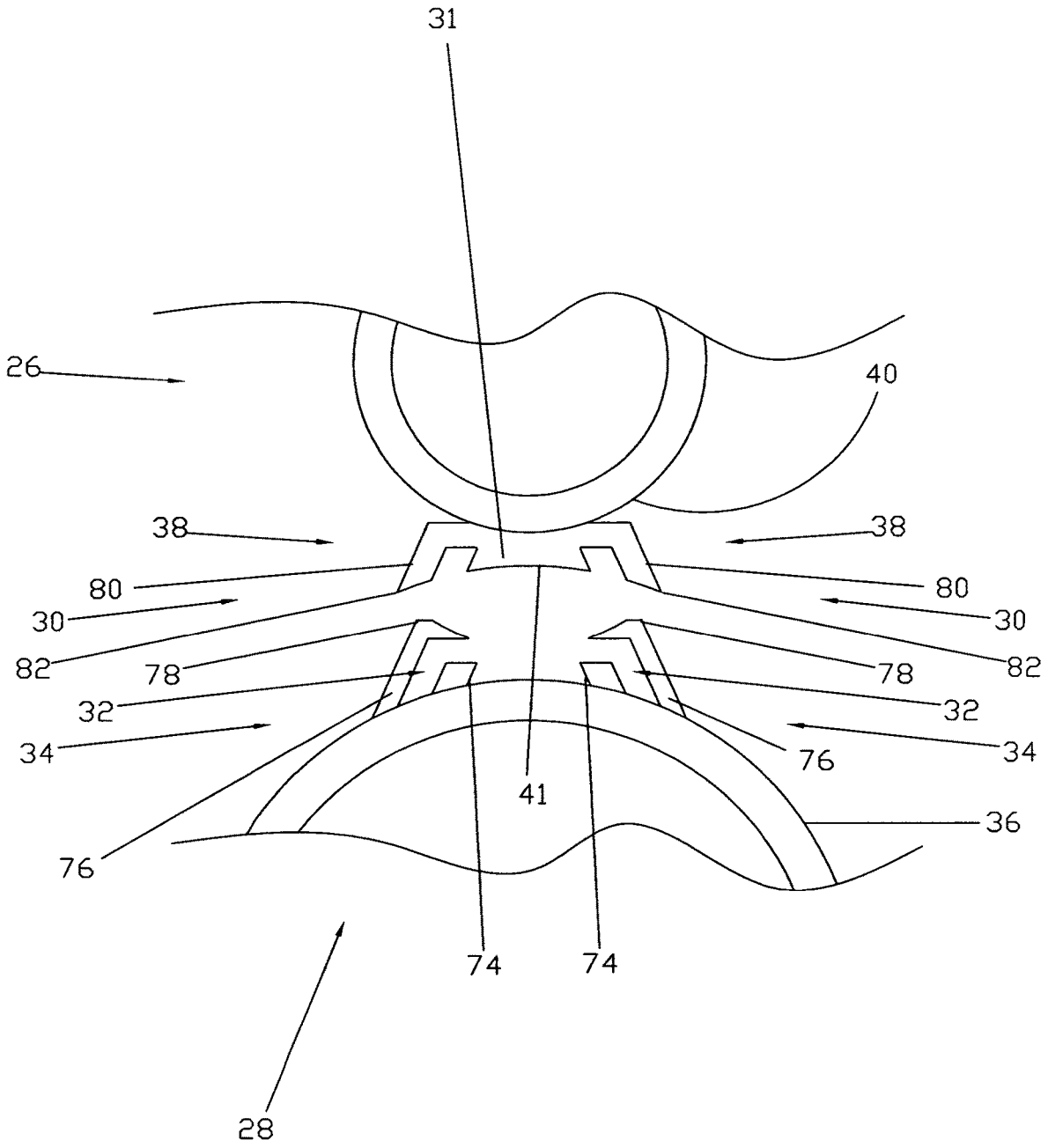
FIG. 5 is an exploded detailed view of the coupling assembly of the trolling motor mounting system of the present invention.

As best shown in FIGS. 2, 3, and 5, the propulsion unit housing 22 comprises a hollow upper housing member generally indicated as 26 and a hollow lower housing member generally indicated as 28 coupled together by a coupling assembly generally indicated as 30 extending longitudinally along opposite sides of the propulsion unit housing 22. In particular, the coupling assembly 30 comprises a first coupler including a first coupler or groove 32 formed by a pair of attachable members each generally indicated as 34 extending upwardly from the upper portion or surface 36 of the hollow lower housing member 28 along the length thereof and a second coupler or tongue generally indicated as 38 extending downwardly from the lower portion or surface 40 of the hollow upper housing member 26 along at least the major portion of the length thereof disposed on opposite sides of a lower support member 31 formed on the lower surface 40 of the hollow upper housing member 26 and including a concave lower surface 41 (see FIG. 5). A housing back plate 42 extends across a portion of the rear of the hollow upper housing member 26 and the hollow lower housing member 28; while, a housing front plate 44 extending across the interior of the hollow lower housing member 28 is disposed inwardly between the front end of the hollow lower housing member 28 and the front of the electric drive or propulsion unit 14 to form a forward recess 46 terminating in a lower port 47 at the forward end of the hollow lower housing member 28.

The hollow upper housing member 26 comprises a shaft receiving post 48 including an upper countersink shaft receiving recess 50 to receive the lower portion of the hollow elongated member or shaft 24 having a seal such as an adhesive, O-ring 52 or other suitable water tight seal disposed thereon. An upper housing passage or channel 54 formed in the hollow upper housing member 26 extends from a port 55 formed in the lower portion of the shaft receiving post 48 of the hollow upper housing member 26 to an upper port 56 in the forward end of the hollow upper housing member 26.

The system housing further comprises a forward housing generally indicated as 58 comprising a hollow nose cone 60 forming a forward housing passage or channel 61 having an upper member or projection 62 including an upper forward passage or channel 64 and a lower member or projection 66 including a lower forward passage or channel 68 projecting inwardly from the hollow nose cone 60. The upper member or projection 62 and lower member or projection 66 are each configured to support a seal or O-ring 70 to press-fit into the upper port 56 of the hollow upper housing member 26 and the lower port 47 of the hollow lower housing member 28 respectively to seal the front portion of the propulsion unit housing 22 and the rear portion of the forward housing 58 together.

When operatively assembled, the first or shaft passage or channel 25 and the second or housing passage or channel comprising the upper housing passage or channel 54, upper forward passage or channel 64, forward housing passage or channel 61 and lower forward passage or channel 68 cooperatively form an open passageway from the boat (not shown) and the electric drive or propulsion unit 14 to receive the conductor or cable 20 that electrically connects or couples the electric drive or propulsion unit 14 to the electric power source (not shown). So configured and assembled, the conductor or cable 20 is isolated from the surrounding water.

Figure 4:
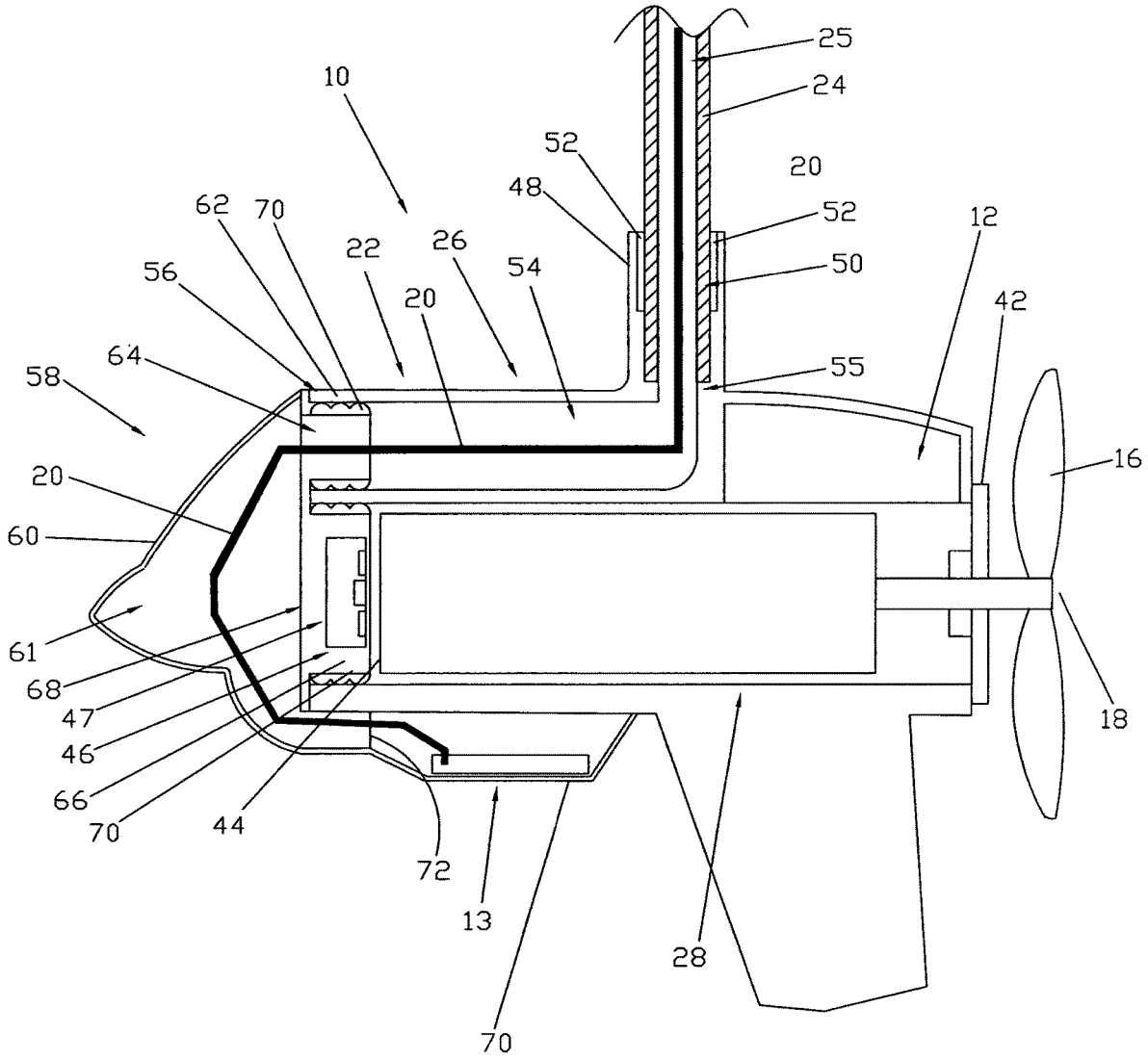
FIG. 4 is a partial cross-sectional side view of an alternate embodiment of the trolling motor mounting system of the present invention.

FIG. 4 depicts a similar trolling motor mounting system for use with a sonar transducer with similar structural components similarly designated or identified.

Specifically, the present invention relates to a trolling motor mounting system generally indicated as 10 to mount a trolling motor generally indicated as 12 and a sonar transducer generally indicated as 13 to a boat (not shown).

The trolling motor 12 comprises an electric drive or propulsion unit 14 coupled to a propeller or thruster 16 by a drive shaft 18. The sonar transducer 13 is connected to a display panel or control (not shown) by a conductor or cable 20.

The trolling motor mounting system 10 comprises a system housing including a propulsion unit housing generally indicated as 22 to at least partially enclose the electric drive or propulsion unit 14 coupled to the boat (not shown) by a rotatable hollow elongated member or shaft 24 including a first or shaft passage or channel 25.

The propulsion unit housing 22 comprises a hollow upper housing member generally indicated as 26 and a hollow lower housing member generally indicated as 28 are coupled together by a coupling assembly generally indicated as 30 extending longitudinally along opposite sides of the propulsion unit housing 22 (see FIG. 5). In particular, each coupling assembly 30 comprises a first coupler including a groove 32 formed by a pair of attachment members each generally indicated as 34 extending upwardly from the upper portion or surface 36 of the hollow lower housing member 28 along the length thereof and a second coupler including a tongue generally indicated as 38 extending downwardly from the lower portion or surface 40 of the hollow upper housing member 26 at least a major portion along the length thereof disposed on opposite sides of a lower support member 31 formed on the lower surface 40 of the upper hollow housing member 26 and including a concave surface 41 to engage the upper surface 36 of the lower hollow housing member 28 (see FIG. 5). A housing back plate 42 extends across a portion of the rear of the hollow upper housing member 26 and the hollow lower housing member 28; while, a housing front plate 44 extending across the interior of the hollow lower housing member 28 is disposed inwardly between the front end of the hollow lower housing member 28 and the front of the electric drive or propulsion unit 14 to form a forward recess 46 terminating in a lower port 47 at the forward end thereof.

The hollow upper housing member 26 comprises a shaft receiving post 48 including an upper countersink shaft receiving recess 50 to receive the lower portion of the hollow elongated member or shaft 24 having a seal such as an adhesive, O-ring 52 or other water tight seal disposed thereon. An upper housing passage or channel 54 formed in the hollow upper housing member 26 extends from a port 55 formed in the lower portion of the shaft receiving post 48 of the hollow upper housing member 26 to an upper port 56 in the forward end of the hollow lower housing member 28.

The system housing further comprises a forward housing generally indicated as 58 comprising a hollow nose cone 60 forming a forward housing passage or channel 61 and having an upper member or projection 62 including an upper forward passage or channel 64 and a lower member or projection 66 including a lower forward passage or channel 68 projecting inwardly from the hollow nose cone 60. The upper member or projection 62 and lower member or projection 66 are each configured to support a seal such as an adhesive or O-ring 70 to press-fit into the upper port 56 of the hollow upper housing member 26 and lower port 47 of the hollow lower housing member 28 respectively to seal the front portion of the propulsion unit housing 22 and the rear portion of the forward housing 58 together.

The sonar transducer 13 is located or disposed within a hollow sonar enclosure 70 attached to or formed on the hollow lower housing member 28. The hollow sonar enclosure 70 includes a sealed sonar port or opening 72 by an adhesive, O-ring or other suitable water tight seal in open communication with the forward housing passage or channel 61.

When operatively assembled, the first or shaft passage or channel 25 and the second or housing passage or channel comprising the port 55, upper housing passage or channel 54, upper forward passage or channel 64, forward housing passage or channel 61 and sonar port or opening 72 cooperatively form an open passageway from the boat (not shown) to the electric drive or propulsion unit 14 and sonar 13 to receive the conductor or cable 20 that electrically connects or couples the electric drive or propulsion unit 14 to the electric power source (not shown). So configured and assembled, the conductor or cable 20 is sealed and isolated from the surrounding water and the sonar 13 to a display (not shown).

FIG. 5 is a detailed end view of the coupling assembly 30 to interlock the hollow upper housing member 26 and hollow lower housing member 28 together. Specifically, as previously described each coupling assembly 30 comprises a first coupler or groove 32 formed by a pair of attachment members 34 extending upwardly from the upper portion or surface 36 of the hollow lower housing member 28 and a second coupler or tongue 38 extending downwardly from the lower portion or surface 40 of the hollow upper housing member 26.

Each pair of attachment members 34 comprises an inner attachment element 74 and an outer attachment element 76 including a lower inwardly slanted or inclined leg extending upwardly from the upper portion or surface 36 of the hollow lower housing member 28 terminating in an upper inwardly extending projection or retainer leg 78.

Each tongue 38 comprises an upper outwardly slanted or inclined leg 80 extending downwardly from the lower portion or surface 40 of the hollow upper housing member 26 terminating in a lower outwardly extending projection or retainer leg 82.

The slant or inclination of each groove 32 and upper outwardly slanted or inclined leg 80 of the corresponding tongue 38 are sized and configured such that corresponding tongue and groove combination of each coupling assembly 30 fit together to permit the hollow upper housing member 26 and hollow lower housing member 28 to be assembled by sliding the tongue 38 within the corresponding groove 32 and once fully assembled and snugly secured in place by the lower outwardly extending projection or retainer leg 82 and corresponding upper inwardly extending projection or retainer leg 78 overlapping each other.

Figure 6:
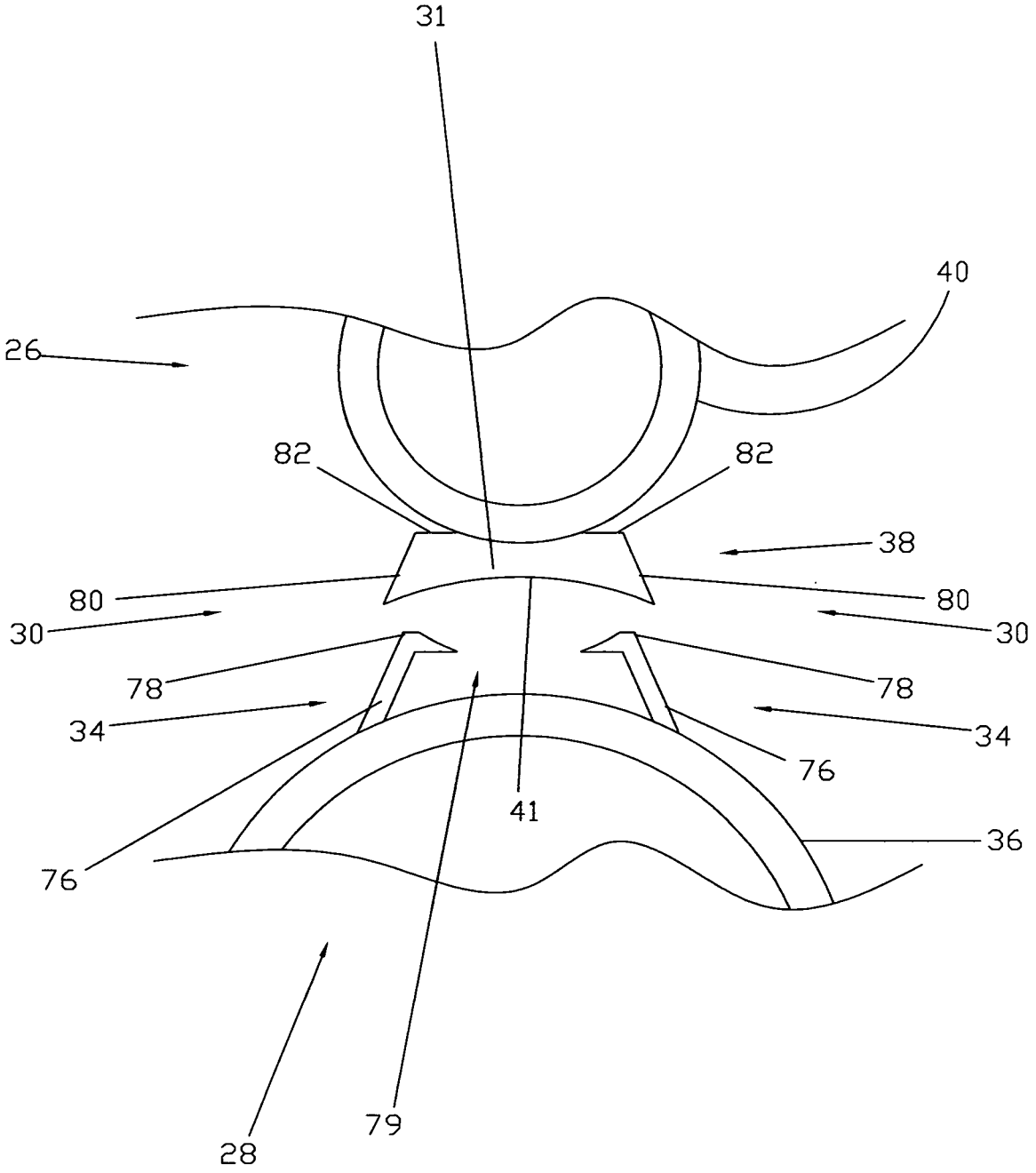
FIG. 6 is an exploded detailed view of an alternate embodiment of the coupling assembly of the trolling motor mounting system of the present invention.

FIG. 6 is a detailed end view of an alternate embodiment of the coupling assembly 30 coupler or to interlock the hollow upper housing member 26 and hollow lower housing member 28 together. Specifically, each coupling assembly 30 comprises a first coupler or outer attachment member generally indicated as 34 extending upwardly from the upper portion or surface 36 of the hollow lower housing member 28 and a second coupler generally indicated as 38 extending downwardly from the lower portion or surface 40 of the hollow upper housing member 26.

Each first coupler or outer attachment member 34 comprises a lower inwardly slanted or inclined leg 76 extending upwardly from the upper portion or surface 36 of the hollow lower housing member 28 terminating in an upper inwardly extending projection or retainer leg 78 to cooperatively form an opening or channel 79 therebetween.

The second coupler 38 comprises a lower support member 31 extending downwardly from the lower portion or surface 40 of the hollow upper housing member 26 including a lower concave surface 41 to engage the upper convex surface 36 of the hollow lower housing member 28 and a lower outwardly extending surface 80 formed on each side of the lower support member 31.

The slant or inclination of each groove 32 and upper outwardly slanted or inclined leg 80 of the corresponding tongue 38 are sized and configured such that corresponding tongue and groove combination of each coupling assembly 30 fit together to permit the hollow upper housing member 26 and hollow lower housing member 28 to be assembled by sliding the tongue 38 within the corresponding groove 32 and once fully assembled and snugly secured in place by the lower outwardly extending projection or retainer leg 82 and corresponding upper inwardly extending projection or retainer leg 78 overlapping each other.

The channel 79 formed by the lower inwardly slant or inclination legs 76 and upper inwardly extending projections or retainer legs 78 of the first coupler or outer attachment members 34 are sized and shaped or configured to receive the second coupler 78 such that the outer surface of each lower outwardly extending surface 80 engages the inner surface of the corresponding lower inwardly slanted or inclined leg 76 of the corresponding first coupler or outer attachment member 34; while, contained.

The upper surface 82 of the second coupler 38 on each side of the hollow upper housing member 26 engages the lower surface of the corresponding upper inwardly extending projection or retainer leg 78 of the corresponding first coupler or outer attachment member 34 to secure the hollow upper housing member 26 and the hollow lower housing member 28 when the trolling motor system 10 is fully assembled.

As shown in FIGS. 1 and 4, the shaft receiving port 48 and shaft 24 may be disposed rearward or aft the center of gravity of the system housing propulsion unit 14, thruster 16 and drive shaft 18.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

In describing the invention, certain terms are used for brevity, clarity, and understanding. No unnecessary limitations should be inferred beyond the requirement of the prior art because such terms are used for descriptive purposes and are intended to be broadly construed. The different structural and functional elements, apparatuses, devices, compositions, and methods described herein may be used alone or in combination with other structural and functional elements, apparatuses, devices, compositions, systems and methods.

It is also to be understood that the following claims are intended to cover all of the generic and specific features of the invention herein described, and all statements of the scope of the invention which, as a matter of language, might be said to fall therebetween.

What is claimed is:

1. A trolling motor mounting system comprising a housing including a forward portion to at least partially enclose a drive unit of a trolling motor and a shaft to couple the trolling motor to a boat wherein said shaft includes a first passage extending at least a major portion thereof and said housing includes a second passage extending from said first passage to the drive unit to cooperatively form a channel to receive a conductor therethrough to supply power and data from the boat to the drive unit to seal and isolate the conductor from the surrounding or outside environment, said housing comprises a hollow upper housing member including a lower surface and a separate lower housing member including an upper surface coupled together by a coupling assembly extending longitudinally along opposite sides of said housing.

2. The trolling motor mounting system of claim 1 wherein said coupling assembly comprises a first coupler extending upwardly from each side of said separate hollow lower housing member and a second coupler extending downwardly from each side of said hollow upper housing member, each said first coupler disposed to engage a corresponding second coupler respectively on each side of said housing to secure said hollow upper housing member and said separate lower housing member together.

3. The trolling motor mounting system of claim 2 wherein each said first coupler comprises a groove and each said second coupler comprises a tongue to engage said corresponding groove.

4. The trolling motor mounting system of claim 3 wherein each said first coupler comprises a groove formed by a pair of attachment members extending upwardly from said separate hollow lower housing member.

5. The trolling motor mounting system of claim 2 further including a lower support member formed on said hollow upper housing member disposed between said second coupler, said lower support member having a concave surface to engage said separate hollow lower housing between said second couplers.

6. The trolling motor mounting system of claim 1 further including a housing back plate extending across a portion of said rear of said hollow lower housing member and a housing front plate extending across an interior of said hollow lower housing member disposed inwardly between a front end of said separate hollow lower housing member and the drive unit to form a forward recess terminating in a lower port at said forward end of said separate hollow lower housing member.

7. The trolling motor mounting system of claim 1 wherein said hollow upper housing member includes a shaft receiving post including an upper countersink shaft receiving recess to receive a lower portion of said shaft having a tight seal disposed thereon.

8. The trolling motor mounting system of claim 1 further including upper housing passage or channel formed in said hollow upper housing member extending from a port formed in a lower portion of said shaft receiving post of said hollow upper housing member to an upper port formed in a forward end of said hollow upper housing member.

9. The trolling motor mounting system of claim 1 further comprises a forward housing including a hollow nose cone forming a forward housing passage or channel having an upper member projection having an upper forward passage or channel and a lower member projection including a lower forward passage or channel projecting inwardly from said hollow nose cone.

10. The trolling motor mounting system of claim 9 wherein said upper member or projection and said lower member or projection are each configured to support a seal to press-fit into said upper port of said hollow upper housing member and said lower port of said hollow lower housing member respectively to seal said front portion of said propulsion unit housing and said rear portion of said forward housing together.

11. The trolling motor mounting system of claim 1 further including sonar transducer disposed within a hollow sonar enclosure attached to said separate hollow lower housing member, said hollow sonar enclosure includes a sonar port or opening in open communication with a forward housing passage formed in said forward portion of said housing.

12. The trolling motor mounting system of claim 1 wherein said housing includes a channel from the electric power source to the drive motor comprising said first passage and said second housing passage including an upper housing passage, upper forward passage, forward housing passage and lower forward passage forming an open passageway from the boat to the electric drive or propulsion unit to receive the conductor or cable that electrically connects or couples the electric drive or propulsion unit to the electric power source.

13. The trolling motor mounting system of claim 1 further includes a coupling assembly disposed on opposite sides of said housing to interlock said hollow upper housing member and said separate hollow lower housing member, each said coupling assembly comprises a first coupler extending upwardly from said hollow lower housing member and a second coupler extending downwardly from said hollow upper housing member disposed to engage the corresponding coupler.

14. The trolling motor mounting system of claim 13 wherein each said first coupler comprises a lower inwardly slanted or inclined leg extending upwardly from said separate hollow housing member terminating in an inwardly extending projection or retainer leg to cooperatively form a groove between said first couplers and wherein each said second coupler comprises a lower support member or tongue extending downwardly from said hollow upper housing member to engage lower inwardly slanted or inclined legs within said groove.

15. The trolling motor mounting system of claim 14 wherein said groove and said tongue are configured to permit said hollow upper housing member and said separate hollow lower housing member to be assembled by sliding said tongue within the said groove.

16. The trolling motor mounting system of claim 1 wherein each said coupling assembly comprises a first coupler or groove formed by a pair of attachment members extending upwardly from said upper surface of said separate housing lower housing member and a second coupler or tongue extending downwardly from said lower surface of said hollow upper housing member, each pair of attachment members comprises an inner attachment element and an outer attachment element including a lower inwardly slanted or inclined leg extending upwardly from said upper surface of said separate hollow lower housing member terminating in an upper inwardly extending projection or retainer leg and each tongue comprises an upper outwardly slanted inclined lag extending downwardly from said lower surface of said hollow upper housing member terminating in a lower outwardly extending projection or retainer leg wherein said slant or inclination of each said groove and said upper outwardly slanted or inclined leg of the corresponding tongue are configured such that corresponding tongue and groove of each said coupling assembly fit together to permit said hollow upper housing member and said separate hollow lower housing member are assembled by sliding said tongue within the corresponding groove and secured in place by said lower outwardly extending projection or retainer leg and corresponding upper inwardly extending projection or retainer leg overlapping each other.

* * * * *